United States Patent [19]

Mackenzie et al.

[11] 4,044,695

[45] Aug. 30, 1977

[54] MULTI-STAGE PNEUMATIC MUNICIPAL SOLID WASTE SEPARATION AND RECOVERY OF A PLURALITY OF CLASSIFICATIONS

[75] Inventors: Harold B. Mackenzie, Wheaton, Ill.; Ingvar G. Anderson, Dunedin, Fla.

[73] Assignee: New Life Foundation, Wheaton, Ill.

[21] Appl. No.: 662,240

[22] Filed: Feb. 27, 1976

[51] Int. Cl.[2] ..... F23G 5/00; F23K 1/00

[52] U.S. Cl. ..... 110/8 P; 110/106; 241/76

[58] Field of Search ..... 110/7 R, 8 R, 8 P, 15, 110/28 R, 106; 241/76, 77, 78

[56] References Cited

U.S. PATENT DOCUMENTS

| | | | |
|---|---|---|---|
| 1,142,706 | 6/1915 | Hidoux | 110/8 X |
| 1,775,324 | 9/1930 | Runge et al. | 110/8 X |
| 2,148,447 | 2/1939 | Dundas et al. | 110/15 |
| 2,213,668 | 9/1940 | Dundas et al. | 110/15 |
| 3,951,081 | 4/1976 | Martin et al. | 110/8 |

*Primary Examiner*—Kenneth W. Sprague

*Attorney, Agent, or Firm*—Hill, Gross, Simpson, Van Santen, Steadman, Chiara & Simpson

[57] ABSTRACT

Heterogeneous municipal solid waste is pneumatically separated in a first stage into relatively heavy incombustible and lighter weight combustible fractions. The first stage light combustible fraction is further pneumatically separated in a second stage into heavier grade fuel and lighter grade fuel fractions. In a third stage still further separation may be effected of the second stage lighter grade fraction into a heavier fraction suitable for other uses such as in the manufacture of certain building materials and a lightest fraction most suitable for air suspension boiler or kiln firing. Primary shredding of all of the solid waste to be pneumatically separated, and final reshredding of the fuel grade materials are provided for to attain maximum combustion efficiency.

Apparatus for effecting large volume continuous process multi-stage pneumatic separation comprises serially connected pneumatic tower separators including means for controlling air velocity and volume to meet a wide variety of conditions in the solid waste materials being handled.

21 Claims, 5 Drawing Figures

MULTI-STAGE PNEUMATIC MUNICIPAL SOLID WASTE SEPARATION AND RECOVERY OF A PLURALITY OF CLASSIFICATIONS

This invention relates to municipal solid waste separation for recovering a plurality of classifications of materials from the waste and more particularly concerned with a system capable of efficient, economical large-volume continuous multi-stage operation.

Disposal of municipal solid waste creates an enormous problem in most communities and the larger the communities and the denser the population, the larger the problem. In many communities land fill or dumping sites are becoming scarcer and often ecologically undesirable. Incineration is frequently resorted to at enormous expenditures of energy and is usually a totally wasteful manner of waste disposal. Although there have been numerous examples of prior classification systems according to which various sizes of the same material such as ore, coal and the like are graded, we are not aware of any prior teaching of how to attain maximum fuel yield from heterogeneous municipal waste. While it has heretofore been proposed to separate combustible materials from relatively incombustible materials by single-stage air classification, the combustible materials have been used all together and without further separation for whatever combustion requirements existed. That is, dense and lightweight combustibles have been used together, as one fuel, without any attempt at separation.

From 60 to 80% of heterogeneous municipal solid waste is organic in nature, and if separated and recovered, may be useful such as for conversion into building materials such as building board and roofing felt, or for use as fuel in various types of combustion means such as cement kilns and industrial boilers, at least supplemental to and conserving of ever scarcer fossil fuels.

An important object of the present invention is to effect the efficient, economical large volume recovery from heterogeneous municipal solid waste of a plurality of classifications of materials suitable for fuel and other uses.

Another object of the invention is to provide a new and improved municipal solid waste separation and recovery system resulting in an improved fuel source particularly useful for electric utility boiler firing and cement kiln firing.

A further object of the invention is to provide a new and improved system for the recovery from heterogeneous municipal solid waste of fuel suitable for grate firing, and fuel suitable for air suspension firing of boilers and cement kilns.

Yet another object of the invention is to provide new and improved apparatus for efficient, high volume municipal solid waste separation and especially adaptable for efficiently pneumatically separating useful materials from such waste of widely varying characteristics, in a continuous operation.

According to features of the invention, there is provided a system of municipal solid waste separation and fuel recovery, comprising effecting primary shredding of heterogeneous municipal solid waste, pneumatically separating said primary shredded waste in a first separating stage into lighter and primarily combustible waste materials and high-density, heavier and primarily non-combustible waste materials, and pneumatically separating said first-stage lighter combustible waste materials in a second separating stage into a relatively heavy-density fuel fraction classification and a relatively light-density fuel fraction classification. The light-density fuel fraction is reshredded for optimum air suspension combustion firing. The second-stage light-density fuel fraction may sometimes be further pneumatically separated in a third-stage separator to recover therefrom relatively heavier waste materials, primarily shredded mixed paper suitable for uses other than as fuel, as for example, in manufacture of building products such as roofing and sheathing paper, wallboard and composition shingles.

The present system of multi-stage pneumatic separating is aimed primarily at separating out classifications of materials, whether for fuel purposes or other uses, while the materials remain in heterogeneous mixture of many different materials. Density, specific gravity and aerodynamic differences as well as size of the wide variety of materials being heterogeneously classified are factors to be taken into account in attaining the desired classifications. For example, some fuel requirements necessitate substantial separation of chlorine-releasing materials such as polyvinyl chloride to avoid corrosion damage to boilers and boiler-associated apparatus, and deterioration of clinker product quality in cement manufacture. The present system attains this desirable classification result.

A further desirable feature of the invention resides in reshredding both heavier and lighter classifications of combustible materials and feeding the heavier and lighter classifications separately into utility boilers in a manner to attain maximum combustion efficiency from the respective classifications of shredded waste fuel materials.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure and in which.

Figure 1:
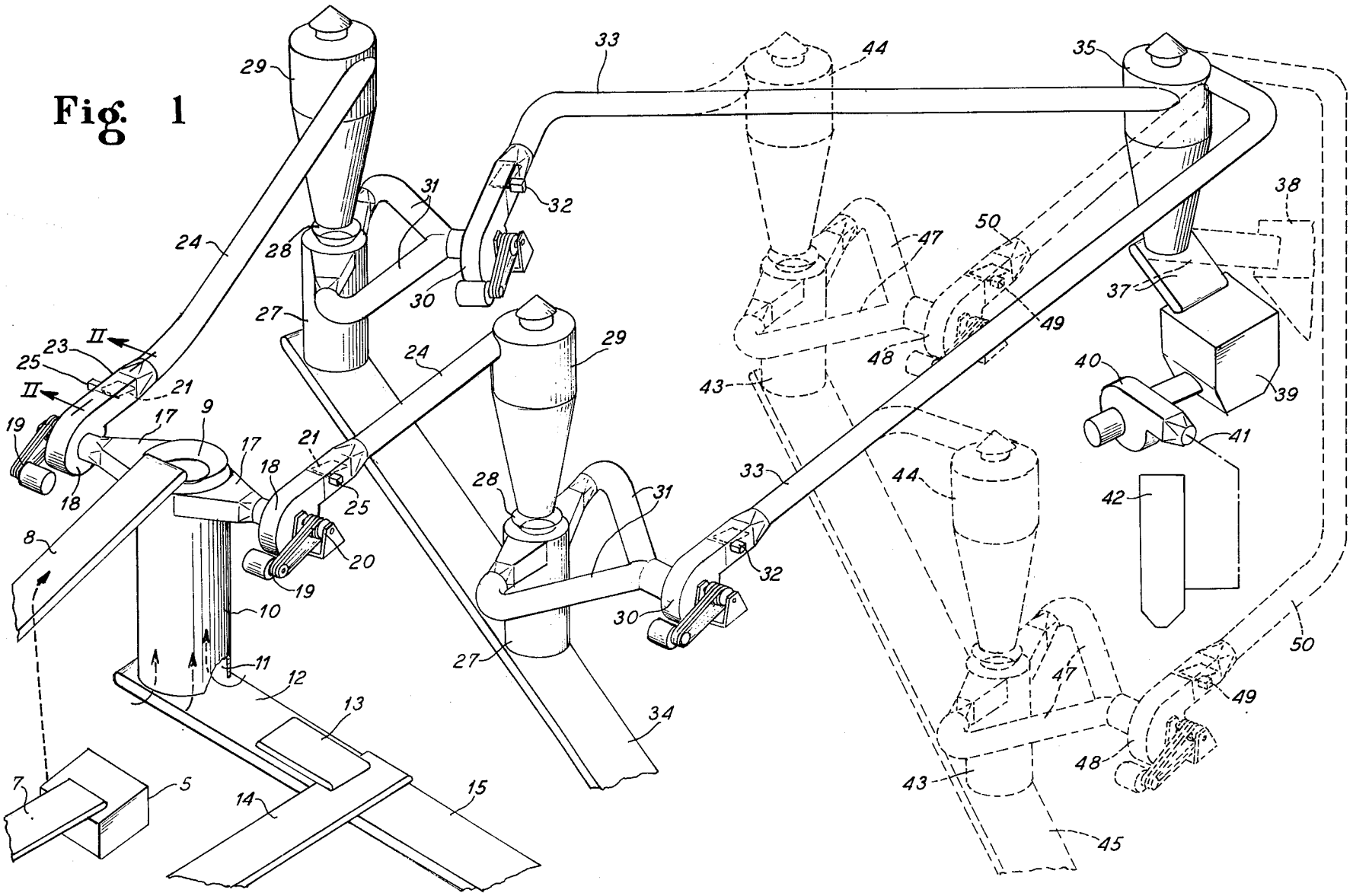
FIG. 1 is a schematic illustration showing a system embodying features of the invention.

Heterogeneous municipal solid waste which may contain any solid waste materials such as are commonly collected by municipal pick-up collection and disposal units whether publicly owned or private, and including any solid waste materials which may be generally and variously referred to as refuse, trash, garbage and the like, intermingled as collected, is delivered to a central collection site for processing according to the present invention. As delivered to the site, the heterogeneous waste may be initially manually separated to remove some larger salvageable objects and materials such as cardboard and metal. However, modern refuse collection equipment generally compacts and breaks up collected materials into proportions that can be handled by a primary shredder 5 (FIG. 1) into which the material is delivered in the condition received as by means of a conveyor 7. After primary, relatively coarse shredding, the heterogeneous municipal waste is delivered as by means of a conveyor 8 into a funnel-like mouth head 9 of a first-stage pneumatic separator 10.

In a preferred form, the separator 10 may be of the kind covered in U.S. Pat. No. 3,833,117 capable of handling a large volume of material such as on the order of up to 75 or more tons per hour with utmost efficiency. To this end, the pneumatic separator 10 comprises a large diameter substantial height vertical columnar casing open at the bottom into a separation chamber 11 into which a massive volume of air as indicated by arrows is drawn and circulated upwardly through the descending waste material whereby that considerable "heavies" fraction such as from 20 to 35%, depending on general content and which is of such weight and density as to resist the forceful updraft of air within the chamber, drops onto a collection device such as a heavies conveyor 12. Materials in this category will consist primarily of non-combustible waste such as metals, glass, rock, sand, and dirt, although there may be some dense, heavy combustible material such as heavy pieces of wood, heavy plastic items such as polyvinyl chloride pieces, heavy rubber items, and the like. Where it is desired to salvage ferrous metals the heavy materials may be carried by the conveyor 12 to a magnetic separator 13 which will remove the salvageable ferrous metal to be conveyed to a collection point as by means of a conveyor 14, while the remaining material may be carried off as by means of a conveyor 15 for land fill deposit, with possible intermediate recovery of glass cullet and aluminum.

Combustible material comprising primarily the coarsely shredded paper, corrugated and other boxboard, rags, leaves and other organic trash, light pieces of wood, light plastic, rubber, etc., some food wastes, etc., are lighter in weight and density and separated from the heavies by the air stream within the chamber 11 and carried upwardly and out of the chamber 11 through one or more exhaust throats 17 communicating with the upper end of the stack-like separator casing 10. Pneumatic draft is produced by means of large volume blower fans 18 operatively connected to the respective throats 17 and driven as by means of variable speed motors 19 coupled thereto as by means of endless flexible drive 20. Selective variable-drive driving of the blower 18 is desirable for adjustment of air velocity to accommodate variable content and condition of the waste materials being processed which may vary greatly from time to time as to moisture content and character of the wastes. During rainier seasons the moisture content may be high and require maximum air velocity. During dry seasons the moisture content may be low and effective separation achieved with lower velocity.

Figure 2:
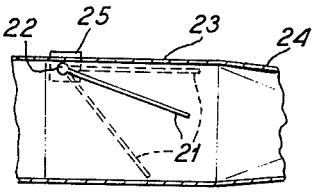
FIG. 2 is an enlarged fragmentary sectional detail view taken substantially along the line II—II of FIG. 1.

In addition to controlling air velocity, it may be desirable from time-to-time to control the volume delivered by one or all of the blower fans 18. For this purpose a damper 21 may be installed either upstream or downstream from the respective blower fan 18, preferably downstream as shown. Such damper may be in the form of a movable plate hingedly mounted as at 22 (FIG. 2) along its proximal edge at the top of a damper housing 23 forming part of a suitable volume duct 24 downstream from the associated blower fan 18. Suitable means represented at 25 are provided for controlling the position of the damper plate 21 between the fully open phantom position as shown at the top of FIG. 2 and the fully closed position as shown at the bottom of FIG. 2, and generally at some intermediate point as shown in full line. Thereby, the volume and velocity of the air stream in the chamber 10 can be readily controlled. This capability of adjusting air volume and velocity is a desirable feature to assure qualitative as well as quantitative control, minimizing carry-over of incombustible materials with the combustible materials, all depending on the character of the raw heterogeneous wastes supplied to the separator 10.

After first-stage separation of the waste material, the light combustible fraction separated out in the classifier or separator 10 is delivered by each duct 24 to a second-stage classifier or separator 27. Where two of the delivery ducts 24 lead from the primary separator 10, both may lead to the same separator 27, but for utmost efficiency in separating the combustible material into different fuel fractions, each of the ducts 24 may, as shown, deliver to a separate one of the separators 27. The structure and operation of each of the separators 27 may be substantially the same as described for the separator 10 although because of a smaller volume of material and because of load sharing, the separators 27 may be smaller. A massive volume of air is drawn up through the separator tower or casing chamber of each of the separators 27 for separating the combustible material deposited through the top thereof by way of a funnel delivery throat 28 from an overyling cyclone deaerator 29 into which the duct 24 delivers the combustible material propelled from the separator 10. Controlled air velocity and volume generated in the separator 27 by a variable speed motor driven blower fan 30 by way of one or more suction ducts 31 communicating with the upper end of the separator causes the combustible material delivered to the separator 27 to be separated into a heavier or more dense fraction which drops from the lower end of the separator and a light density fraction which is propelled past a control damper 32 similar in function to the damper 21 and onward into a take-away duct 33. The second stage heavier fuel fraction dropping from each of the separators 27 may comprise primarily shredded corrugated and cardboard, rags, wet paper, organic materials including garbage, heavier plastics, wood, rubber, and the like, and may account at times for from 25 to 50% by volume of material being processed and suitable for grate firing of boilers, sludge incinerators, and the like. This heavier combustible material may be transported away from the secondary separators 27 by means such as a conveyor 34.

As a result of the secondary separation of the combustible material, the second-stage light density fuel fraction may comprise at times from 25 to 50% of the total volume of waste material being processed, depending, of course, upon the character, content and condition of the heterogeneous, primary solid waste material placed into the processing stream at any given time. This second-stage light density fuel fraction, which will generally comprise principally shredded dry paper, film plastic, dry leaves, and the like, is especially suitable for air suspension boiler and kiln firing. In a desirable sequence, the streams of the second-stage light density fuel fraction are delivered by the ducts 33 into a deaerating cyclone 35 feeding to receiving means such as a take-away conveyor 37 which may feed the light density fraction fuel material to collecting bin means 38 or other collection means for delivery to the point of use in a boiler or kiln and there reshredded to the desired particle fineness for efficient air suspension firing. Where the waste separation system is located contiguous to the point of boiler or kiln firing consumption, the take-away conveyor 38 may deliver the light density fuel fraction directly to a reshredder 39 from which the reshredded fuel is continuously propelled by means such as a blower fan 40 for non-stop delivery through a duct 41 to the combustion zone of an air suspension fuel fired boiler 42 or a kiln. If the air volumes and local conditions require, separate cyclones 35 may be used for ducts 33 instead of the one cyclone 35 shown.

To achieve the most rapid ignition and most effective combustion of fuels fed by air suspension means into large combustion chambers, it is highly important to break up any lumping, wadding or compactions which may occur in handling and processing shredded waste, and to reduce each particle of fuel material to be burned to its smallest possible reasonable size so that the maximum area of each particle will be exposed to the heat, oxygen and combustion conditions in the combustion zone. For instance, in large utility boilers fired with pulverized coal, the coal particles are pulverized down to a fineness of 100 to 200 microns, and finer. A salient advantage of lighter density fuel fractions recovered from municipal waste according to the present invention is that upon reshredding, the material is subjected to a tearing action producing tiny fuzzed, fluffy, easily air-borne particles which, on being uninterruptedly conveyed from the reshredder to the boiler or other combustion means will remain substantially free and clear of any other particles so that each particle reaches the combustion zone in the most ignitible, highly combustible condition attainable for particles of this kind of fuel material.

With respect to the heavy fuel fraction which is generally stored prior to burning, the fibrous, torn, irregular nature of the rags, cardboard, twigs, paper, torn plastic, paper and other materials comprising this fuel, its generally moist nature, and the compaction in bulk storage all tend to make this material form lumps, clumps and, wads hampering good combustion. We have found that reshredding the heavy fuel fraction just prior to injection into grate-firing boilers or into air-suspension boilers breaks up such wads, clumps and lumps which naturally form in this material, tends to aerate and dry the material, and of course reduces the particle size and increases the exterior combustible area of each particle, all of which greatly improves the combustibility and energy-recovering value of this heavy fuel fraction material.

Where market conditions warrant making use of fibrous waste for other use than fuel such as in the production of building materials including wallboard, tarpaper, roofing and sheathing paper, composition shingles and the like, the second-stage light density grade fuel fraction material may be further pneumatically separated in one or more third-stage pneumatic classifiers or separators 43 which may be of the same type construction and operation as the separator 10, to separate primarily light shredded cardboard and paper in the second-stage light stream from the lightest fuel materials comprising primarily dry paper, film platic and the lightest density cardboard and other dry waste materials in said second-stage "lights" stream. For this purpose, the ducts 33 may deliver into deaerating cyclones 44 which discharge into the third-stage pneumatic classifiers or separators 43 from which the heavier third-stage, materials, primarily paper and light cardboard, drop onto and are collected by means such as a conveyor 45 which will transport them to a suitable collection point for the intended use. From the upper end of each of the third-stage separators 43, the remaining third-stage light density fuel material is withdrawn through one or more ducts 47 by means of a blower fan 48 under variable velocity control and under volume control as by means of a damper 49, and propelled through a duct 50 into the deaerating cyclone 35. The ducts 50 may also deliver directly into separate deaerating cyclones where such an arrangement is more effective or more economical.

Figure 3:
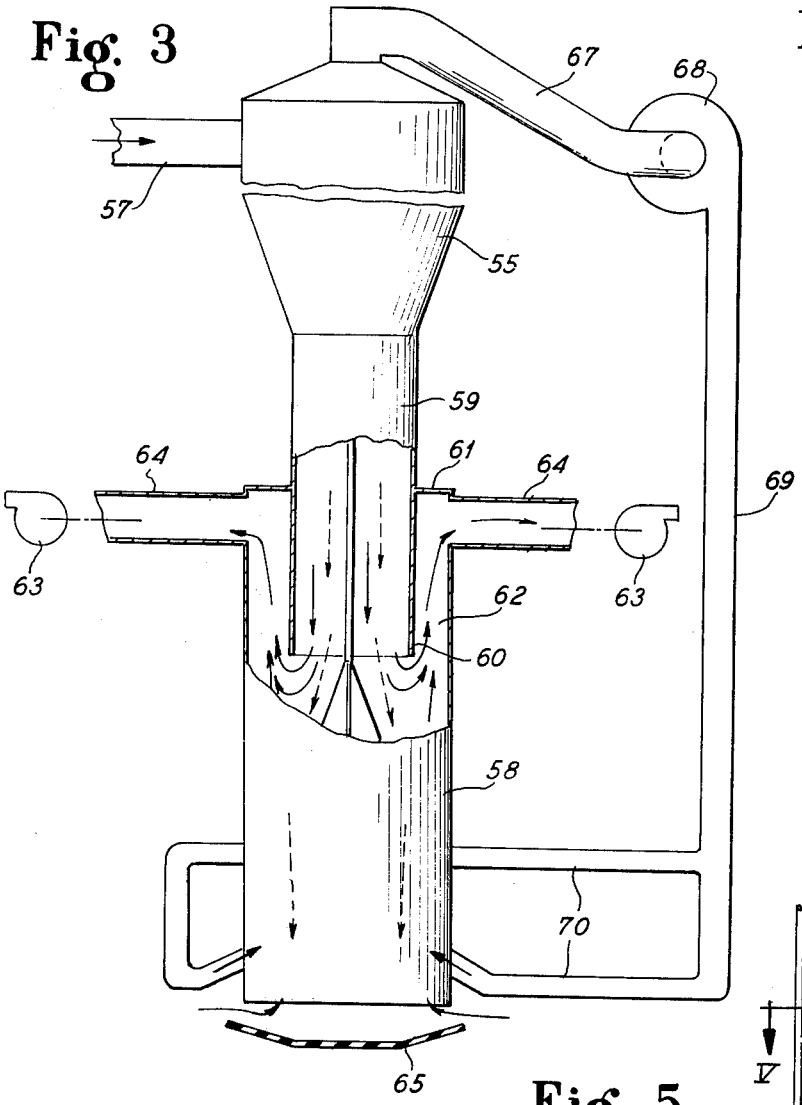
FIG. 3 is a schematic generally elevational view showing a novel cyclone and pneumatic separator arrangement including a novel and improved method of utilizing exhaust air from vents of cyclones positioned above second-stage and third stage separators.

Although as may be observed in FIG. 1 the lower discharge ends or throats of the cyclones 29 and 44 are open and disconnected with respect to the receiving funnel upper ends of the separators 27 and 43, respectively, and the upper exhaust or air outlet ends of the cyclones 29 and 44 are depicted conventionally as open to atmosphere or more likely adapted for communication with dust collector or bagging equipment, improved efficiency may be attained by adoption of the arrangement depicted in FIG. 3 where the air and entrained fines escaping the top of the cyclone are recycled into the positive-pressure material-separating updraft air stream in the associated separator. To this end, as shown, the cyclone 55, which may be substituted for either of the cyclones 29 or 44, receives the in-feed combustible fuel fraction propelled through a duct 57 which may be substantially equivalent to the duct 24 or the duct 33. Substantially deaerated material drops from the cyclone 55 into a separator 58 substantially equivalent to the separators 27 and 43. In this instance, the lower discharge end throat 59 of the cyclone 55 is connected in unbroken relation to a tabular inlet 60 which extends concentrically downwardly to a limited extent through and below a top closure 61 into a separating chamber 62 within the columnar vertical housing of the separator 58. A massive volume of material-separating induced-draft air is circulated upwardly from the lower open end of the separator 58 by means of induced-draft, material-handling, variable speed blower fans 63 connected with exhaust or take-off ducts 64 leading from the upper end of the separator for withdrawing the lighter fraction of the material charged into the separator from the cyclone 55, while the heavier material drops down from the open end of the separator and is received by means such as a take-away conveyor 65. Movement of air into and upwardly in the separator 58, and the separated low density light weight material transported by such air, is indicated by the full line arrows and the movement of material charged into the separator 58 and dropping out of the heavier fraction is indicated by dashed arrows. By having the discharge end of the cyclone in unbroken connection with the inlet 60, such action of the fans 63 assists in maintaining a steady flow of the material dropping from the cyclone since there is no entrance of air into the separator about the discharge end of the cyclone. By thus reducing the amount of air coming down with the material discharged into the separator 58, and by creating a negative pressure at the bottom end of the cyclone, maximum efficiency in dropping out of as much solid material as possible from the cyclone and reduction in the amount of exhaust from the top of the cyclone and thus of dust and fines carried out by the exhaust is attained. Further, elimination of entrance of free air at the discharge end of the cyclone 55 assures maximum efficiency of the suction draft of separating air upwardly through the separator 58, attaining improved pneumatic separating action.

Improvement in efficiency of the arrangements as shown in FIG. 3 is attained by recycling the air and entrained dust and fines from the cyclone 55 into the material separating air stream within the separator 58. For this purpose, an exhaust duct 67 communicating with the upper end of the cyclone 55 leads to a positive-pressure blower fan 68 which drives the air and dust/-fines by way of a duct 69 to one or more branches 70 connected to discharge as a positive-pressure air stream into the lower end portion of the separator 58, supplemented to the induced-draft free air drawn in through the open bottom end of the separator. Thereby useful material is salvaged from the fines, and dust is minimized so that the eventual quantity of dust and the volume of exhaust air from the cyclone that must be handled are much reduced, so that, in turn, the size and capacity of the bag house or other dust control means required to achieve satisfactory air quality in connection with the use of the waste material classifications system is substantially reduced. By adoption of the closed circuit arrangement of FIG. 3 in the second and third stage separators of the present system, efficiency will be increased, costs will be reduced, and a large part of the fines and dust will be finally recaptured and utilized as energy.

Figure 4:
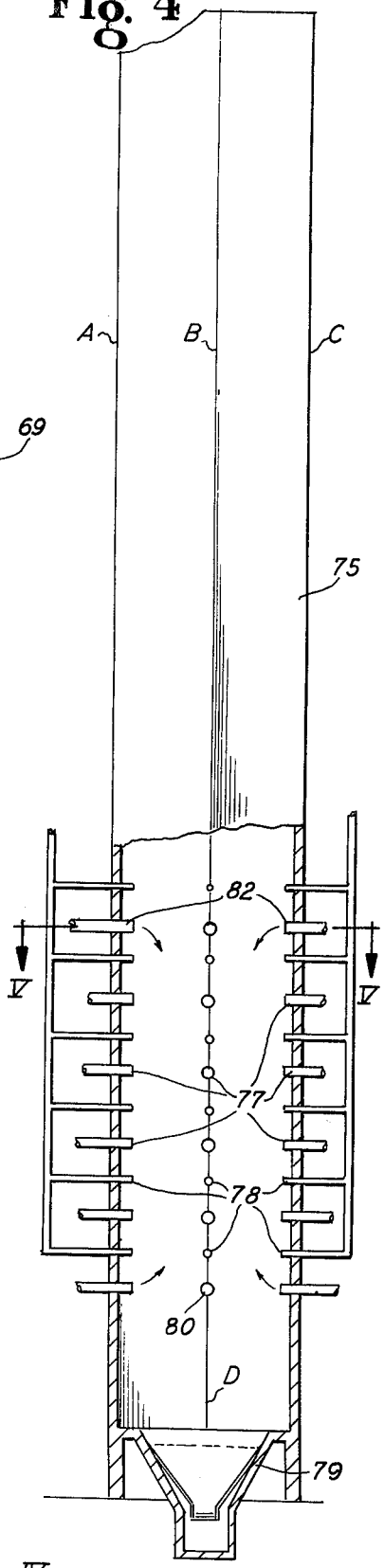
FIG. 4 is a schematic vertical sectional elevational view of a utility boiler embodying features of the invention, the vertical section being taken substantially along the line IV—IV of FIG. 5.
Figure 5:
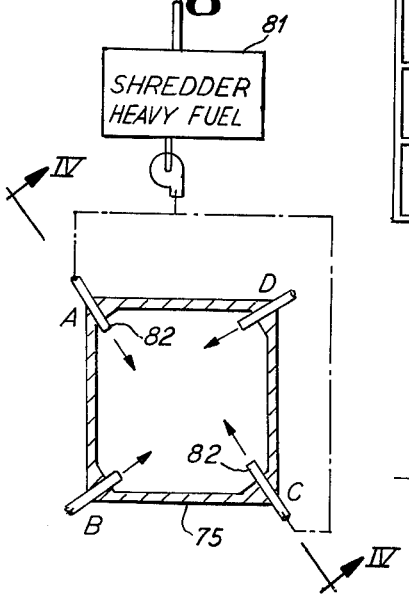
FIG. 5 is a schematic horizontal sectional view taken substantially along the line V—V of FIG. 4.

Use of solid waste fuel as supplemental fuel in electric utility boiler firing has been proposed. However, in all existing systems, solid waste supplemental fuel is all charged into the boilers as one grade or class, and all at the same firing level in the boiler, without regard to density, so that a substantial percentage of the material escapes complete combustion. Greatly improved efficiency of solid waste fuel supplementation is attained by the present invention by enabling charging of the respective light and heavy classification fractions to fuel to the best advantage. Having regard to FIGS. 4 and 5, a typical configuration of a utility boiler comprises a square tubular vertical furnance stack 75, and which may be on the order of 20 to 30 feet on each side, and of a height on the order of 200 to 300 feet. The boiler 75 is provided near its lower end with means for injecting fuel and combustion air at each corner of the boiler stack. For example, there may be from two to six fuel injection nozzles or ports 77 at each corner at common levels and directed in an eccentric pattern to generate a vortex flame condition, with combustion air supplemented through air nozzles 78. Standard fuels may comprise pulverized coal, oil and gas or combinations, depending on the available fuel supply. Because of the necessary intense combustion activity, fuel remains in the combustion chamber for only brief seconds. At the lower end of the boiler stack there may be either a dry or wet bottom ash pit 79 and at the top of the stack there may be suitable dust collectors, precipitators and other effluent cleansing apparatus.

In firing standard utility fuels, each fuel particle is of substantially equal kind to all other particles of the same fuel. It is a unique phenomenon of solid waste fuel that every solid waste stream contains a wide variety of kinds of fuel particles, but all of which can be classified by air as to whether they are "heavies" or "lights." The most efficient waste fuel firing system must take this phenomenon into account.

In utilizing solid waste fuel in a utility boiler of the type exemplified by the boiler 75, a problem of attaining maximum combustion and heat value from the fuel is thus encountered due to the generally extremely heterogeneous character of such fuel, with the particles very unlike as to size, density, speed of ignition and rate of combustion. If such a fuel, with a mixture of combustion materials is introduced into the boiler as one combined fuel stream at a low level in the fuel injection zone for the boiler, the heavy fuel particles tend to drop out unconsumed. If the material is supplied in one stream at a high level in order to assure thorough combustion of the high density heavier particles, then there is a tendency for the particles of light weight and density to be blown up through the stack without complete combustion. However, by utilizing such solid waste fuel separated into relatively heavy density fuel fraction classification and lighter density fuel fraction classification, and supplying the thus separated fuel fractions into that level of the injection zone of the furnace stack best suited for the particular fuel fraction to be most efficiently utilized, maximum combustion and heat value for each classification of fuel are attained. According to the present invention, the reshredded finely particulate lighter density solid waste fuel fraction is introduced through fuel injection nozzles 80 at the lowest possible level in corners B and D of the fuel injection nozzle array zone in the boiler 75 and under suitable air pressure for the particular boiler installation. Thereby, the light, fine fuel particles have the greatest possible retention time in the boiler and must move up through the entire area of most intense combustion activity within the combustion chamber, and the most complete combustion possible of the finely particulate light density waste fuel is assured.

On the other hand, the relatively heavy density fuel fraction material, reshredded in means such as a reshredder 81 to as small a particle size as can be attained for this classification of the solid waste fuel, is introduced into the boiler at the highest possible level in corners A and C of the combustion zone array of fuel nozzles through fuel injection nozzles 82. Thereby, the heavy density fuel particles dropping down within the fuel injection zone of the combustion chamber have the greatest possible retention time in the boiler and are subjected to the area of most intense combustion activity, and the most complete combustion possible is assured. Maximum efficiency in utilization of heat values from the entire solid waste fuel stream, and from each of the two distinct classifications of fuel contained therein, is thus attained, and the escape of unburned or partially burned particles is substantially avoided. Improved operation and efficiency of particulate emission control equipment, such as multicyclones, bag houses, and electrostatic precipitators is also achieved by the more complete combustion of the light fuel particles.

In certain very large utility boilers, heavy solid waste fuel could be injected at the highest possible level at all four corners, and the light particles at the lowest possible level at all four corners, without departing from the spirit and scope of this invention. Also, certain large industrial boilers are "front firing" rather than "corner firing," and have a series of fuel injection ports or nozzles in the front of the boiler, at different levels. In these boilers also, the novel concept of separating solid waste fuel into its two distinct "light" and "heavy" fractions, in a continuous process, and employing separate firing streams so that the heavy fuel fraction can be injected into such a boiler at the highest possible firing level, and the light fuel fraction at the lowest possible firing level, can be employed within the spirit and scope of this invention.

In cement production, the fuel is burned in direct contact with the clinker which leaves the kiln in a red hot, almost molten condition. Ash from the fuel which produces combustion in the kiln becomes part of the cement product. Solid waste fuel is used in cement production, but certain contaminant materials, primarily in the heavy fuel fraction, may introduce undesirable and detrimental results such, for example, as chlorine-releasing materials, of which polyvinyl chloride is an example. Such contaminants may change the color, tensile strength, compression strength and setup time for the cement product and may be so detrimental as to ruin or greatly reduce the value of a batch of the product. Use of suitable solid waste fuel as a supplemental fuel can effect major economies in the cement industry, which is second only to the electrical utility industry in the consumption of fossil fuels. Limitation on use of solid waste fuel in cement making has been the heterogeneous inclusion of undesirable constituents and especially the chlorine-releasing heavy plastics which could contaminate and damage the fuel product. By separating the combustible fraction of solid waste into a heavy fuel fraction and a light fuel fraction, the heavy fuel fraction is available for industrial boiler use while the light fuel fraction, from which the constituents undesirable for cement production are largely eliminated, and consisting very largely of only shredded paper and polyethylene film plastic, will provide an excellent supplemental quality fuel for cement production. Because of its relative freedom from contaminants, the highly combustible, reshredded light weight fraction solid waste fuel is also excellent for other kiln firing operations such as in the manufacture of lime, refractory materials for making fire bricks, and the like.

It will be understood that variations and modifications may be effected without departing from the spirit and scope of the novel concepts of this invention.

We claim as our invention:

1. A system of municipal solid waste separation and fuel recovery, comprising:

effecting primary shredding of heterogeneous municipal solid waste;

pneumatically separating said primary shredded solid waste in a first-stage pneumatic separator into relatively light, low density combustible waste materials and relatively incombustible and high density waste materials;

pneumatically separating said first-stage combustible waste materials in at least one second-stage pneumatic separator into a relatively heavy density classification fuel fraction and a light density classification fuel fraction in a continuous processing operation;

transporting the relatively heavy density classification fuel fraction from said second-stage pneumatic separator; and separately transporting the light density classification fuel fraction from the second-stage pneumatic separator.

2. A system according to claim 1, comprising after said transporting of the light density classification fuel fraction from said second-stage pneumatic separator reshredding the light density classification fuel fraction material immediately prior to firing into finely divided particles especially suitable for air suspension boiler and kiln firing.

3. A system according to claim 1, comprising reshredding the heavier fuel fraction just prior to firing to break up lumps and wads forming during storage and handling of the shredded waste, and improving the firing characteristics of said heavier fuel fraction by reducing the particle size thereof, and by the aeration and drying action of the reshredding just prior to firing.

4. A system according to claim 1, comprising pneumatically separating said second-stage lighter fraction density material in at least one third-stage separator into a heavier fraction of material for a use other than fuel and into a lightest fraction of material for use in air suspension boiler or kiln firing.

5. A system according to claim 1, comprising reshredding the lighter fraction material derived from the second-stage separators into a finely particulate size, and, with minimum handling thereafter, air feeding the reshredded material in the most easily ignitable and most highly and completely combustible condition possible into an air suspension firing combustion device.

6. A system according to claim 1, comprising reshredding said relatively heavy density fuel fraction material, reshredding said lighter density fuel fraction material, introducing the reshredded lighter density fuel material into a lower level of a vertical boiler fuel injection zone, and introducing the reshredded relatively heavy density fuel fraction material into an upper level of the fuel injection zone within the vertical boiler.

7. A system according to claim 1, comprising effecting said first-stage separating in a vertical pneumatic separator, withdrawing the combustible waste materials from the first-stage separator in a plurality of high-velocity large-volume streams, delivering the respective high-velocity large-volume streams of combustible waste materials to respective second-stage vertical pneumatic separators, separating the combustible waste materials into a relatively higher density classification fuel fraction and a light density classification fuel fraction in each of said second-stage separators, transporting the relatively higher density classification fuel fraction from each of said second-stage separators, and separately transporting the light density classification fuel fraction from each of said second-stage separators.

8. A system according to claim 7, comprising delivering streams of the lower density light weight fuel fraction from the second-stage separators into third-stage pneumatic separators and therein separating the lowest density and lightest weight fuel material from said second-stage lower density light weight fuel fraction for air suspension boiler or kiln firing, and recovering the heavier density materials resulting from the third-stage separation for uses other than fuel.

9. A system according to claim 1, comprising adjusting velocity and volume of separating air through said separators for changes occurring during operation in the content and condition of materials being separated.

10. A system according to claim 1, comprising passing the combustible waste materials from said first-stage separator through a cyclone into said second-stage separator, and cycling dust and fines from the exhaust air of the cyclone into positive-pressure material-separating air stream in the second-stage separator.

11. A system according to claim 10, including passing the lighter density fuel fraction material from this second-stage separator into a cyclone atop a third-stage separator, and cycling dust and fines from the exhaust of said third-stage cyclone into positive-pressure material-separating air stream in the third-stage separator.

12. A system of municipal solid waste separation and fuel recovery, comprising:

means for effecting primary shredding of heterogeneous municipal waste;

first-stage pneumatic separating means receptive of and adapted tor separating said primary shredded waste into relatively low density combustible waste materials and relatively incombustible and high density waste materials;

second-stage pneumatic separating means receptive of and adapted for separating the combustible waste materials into relatively light-density classification fuel fraction and a relatively heavier classification fuel fraction;

means for transporting the high density waste materials away from said first-stage pneumatic separating means;

means for delivering the relatively low density combustible waste materials into said second-stage pneumatic separating means;

means for transporting the relatively light-density classification fuel fraction from said second-stage pneumatic separating means; and means for separately transporting the relatively heavier classification fuel fraction from said second-stage pneumatic separating means.

13. A system according to claim 12, including means for reshredding the second-stage light density fuel fraction material into finely divided particles especially suitable for air suspension boiler and kiln firing.

14. A system according to claim 12, wherein said first-stage pneumatic classifying means comprises a separator having a vertical chamber from which the non-combustible and high-density waste materials drop from the bottom, and means for effecting high-velocity, large-volume air circulation upwardly through said chamber for effecting pneumatic separation of lighter material in the chamber, and means for variably adjusting the air velocity and volume.

15. A system according to claim 14, wherein said upward air circulation effecting means comprise a duct leading from said separator, a blower fan in said duct, and said velocity and volume-controlling means comprise a variable-speed drive for the fan and a damper in said duct.

16. A system according to claim 12, wherein said second-stage pneumatic separating means comprise a separator having a vertical separating chamber from the lower end of which the heavier density fuel fraction drops, means for effecting high velocity and volume air circulation upwardly through the chamber and including a plurality of ducts leading from the upper end of the chamber, said plurality of ducts being adapted for combining streams therefrom into a single delivery stream for the light density fuel fraction.

17. A system according to claim 12, wherein said second-stage classifying means comprise a plurality of pneumatic separators receiving the combustible material from said first-stage separator and means for delivering streams of the light-density fuel fraction from said second-stage separators to common reception means for said light density fuel fraction.

18. A system according to claim 12, comprising means for receiving and reshredding the light density fuel fraction into free, fine torn particles of fuzzy, fluffy character, and means for conducting the reshredded particles substantially non-stop from the point of reshredding to an air suspension boiler combustion zone and thereby maintaining the efficiency of the free, fuzzed, fluffy, and utmost combustible state of each individual reshredded fuel particle.

19. A system according to claim 12, including means comprising a third-stage pneumatic separator for further pneumatic separation of the second-stage light density fuel fraction to recover therefrom material suitable for uses other than as fuel.

20. A system according to claim 12, including third-stage pneumatic separating means, said second-stage pneumatic separating means and third-stage pneumatic separating means each comprise a vertical separator and a cyclone atop the separator feeding into the separator, means for delivering the combustible materials serially from said first-stage separating means into the cyclone atop the second-stage separator and then from the second-stage separator into the cyclone atop the third-stage separator, means effecting unbroken communication between the lower end of each of the cyclones and inlet means in the top of the respective associated separator, and means effecting communication between an exhaust vent at the top of each of the cyclones and its associated separator for cycling exhaust air and dust and fines from each of the cyclones into positive-pressure air stream in the associated separator.

21. A system according to claim 12, comprising means for reshredding said second-stage relatively light density fuel fraction material means for reshredding the relatively heavier density second-stage fuel fraction material, a tall vertically standing boiler having a vertical combustion chamber and means in a substantial vertical area in the lower portion of the combustion chamber comprising a fuel injection zone in which fuel is delivered for firing the boiler, means for delivering the reshredded light-density fuel fraction into the combustion chamber at substantially the lowest level in said fuel injection zone, and means for delivering the reshredded heavier density fuel fraction material combustion chamber at substantially the highest level in said fuel injection zone.

* * * * *